United States Patent [19]

McAteer et al.

[11] 4,434,596

[45] Mar. 6, 1984

[54] PARTITION HEAD ASSEMBLY FOR PARTITION WALL PANELS

[75] Inventors: John E. McAteer, Maple Heights; Kenneth E. Bisler, North Royalton; Jerry Ptacnik, Garfield Heights; Richard D. Kish, Lorain, all of Ohio

[73] Assignee: Hauserman, Inc., Cleveland, Ohio

[21] Appl. No.: 949,133

[22] Filed: Oct. 6, 1978

[51] Int. Cl.[3] ..... E04B 2/76

[52] U.S. Cl. ..... 52/243.1

[58] Field of Search ..... 52/238, 239, 240, 241, 52/242, 247, 122, 127, 632, 243.1, 127.2, 127.1; 403/103, 104, 107, 108; 248/259 B, 408, 409, 354 R, 254 S

[56] References Cited

U.S. PATENT DOCUMENTS

| | | | |
|---|---|---|---|
| 2,187,372 | 1/1940 | Capaldo | 248/408 |
| 2,594,605 | 4/1952 | Zoppelt | 248/354 P |
| 2,796,158 | 6/1957 | Miles | 52/241 |
| 2,867,300 | 1/1959 | Bohnsack | 52/238 |
| 3,033,330 | 5/1962 | Fowles | 52/122 |
| 3,171,627 | 3/1965 | Tapley | 248/408 |
| 3,180,457 | 4/1965 | Bohnsack | 52/241 |
| 3,602,373 | 8/1971 | Cassel | 403/107 |
| 3,803,787 | 4/1974 | Daggy | 52/241 |
| 4,018,020 | 4/1977 | Sauer | 52/241 |

FOREIGN PATENT DOCUMENTS

| | | | |
|---|---|---|---|
| 1144339 | 10/1957 | France | 52/238 |

*Primary Examiner*—John E. Murtagh

*Attorney, Agent, or Firm*—Maky, Renner, Otto & Boisselle

[57] ABSTRACT

A partition head assembly for a partition wall panel is characterized by a telescoping head in the top of the partition panel and a strut at at least one end of the head which is adjustably vertically secured to the partition panel at all vertical positions thereof by a strut retaining clip. Vertical adjustment of the head assembly may be obtained without disassembly thereof and with the panel assembled in a partition wall.

29 Claims, 9 Drawing Figures

PARTITION HEAD ASSEMBLY FOR PARTITION WALL PANELS

BACKGROUND OF THE INVENTION

This application pertains to the art of interior wall assemblies, and more particularly to a partition head assembly for an interior movable partition panel.

In previous interior movable partition systems, commonly a continuous length of channel attached to the ceiling supports the individual panels of a partition wall or each panel making up the partition wall is provided with a slidable head member which is extended upwardly either by a mechanical or pneumatic mechanism to adjust for different ceiling heights that may be encountered. It is desirable to provide such type of head assembly for a partition panel which is simple in construction, is easy to assemble, is adjustable without disassembly of the partition wall, is independently adjustable at each end of the panel, provides a sound and light seal with the ceiling as well as between adjacent panels, provides for mounting without connection to the ceiling, provides strength adequate for hanging shelving or casework or work surfaces fully to the height of the panel on both sides thereof and provides an aesthetic and pleasing appearance.

It is also desirable to provide such type of head assembly for a post-less partition panel of the type disclosed in applicant's assignee's copending patent application Ser. No. 882,668, filed Mar. 2, 1978, entitled "Demountable Interior Partition System, Components Therefor, and Method of Making Such Components."

SUMMARY OF THE INVENTION

The present invention is directed to a unique head assembly for partition panels which provides many of the above-noted desirable features. After the panel is placed in position, the head assembly is raised to lock the panel and head assembly in a vertical position in abutment and engagement with the ceiling or clips so as to secure the panel in the vertical plane and form a light and sound seal therewith. Each side of the head assembly is independently adjustable without disassembly thereof to allow for different ceiling heights at opposite ends of the panel. The top of the assembly may engage the ceiling so that the panel is self-supported between ceiling and floor and/or engage suitable fasteners to secure the panel to the ceiling.

According to the preferred construction, the partition head and panel assembly of the present invention is characterized by an elongate head member vertically movable relative to the top of a partition panel and forming an extension thereof. A strut is secured at its upper end to the head member and at its lower end is adjustably vertically secured to the partition panel at all vertical positions thereof by a strut retaining clip. Preferably such strut and clip are provided at each end of the head and panel. The lower portion of each strut is channel-shape and the clip member includes a body and longitudinally extended wings which are slidingly received within the channel and in frictional engagement with the same. The clip and strut include cooperating lock elements for locking positively the strut at any one of a number of discrete positions.

Still according to the preferred construction, the head member along its upper and vertical edges has respectively horizontal and vertical channels in which are positioned, respectively, ceiling and panel trim seals.

Each ceiling and panel trim seal preferably is a plastic co-extrusion having a relatively rigid U-shape body for fastening purposes and relatively flexible flanges extending from the legs of the body for engagement with the ceiling and another panel trim seal, respectively, to form a light and sound seal therebetween. Each seal further has at the distal ends of the legs outwardly extending and flanges for engaging the edges of the head member. The flexible flanges for the panel trim seal are in the form of hollow large flexible beads to ensure proper engagement with the beads of the next adjacent panel trim seal.

The head assembly of the invention is intended particularly for use with a post-less partition panel of the type described in applicant's assignee's above-identified application employing spaced-apart, J-shaped flanges which extend along the vertical mounting edges of the panel and are used to join together the mounting edges of adjacent panels. In such preferred combination of head and panel assembly, the J-shaped flanges define a vertical track which receives for vertical movement therein the strut and precludes lateral movement thereof. Slots are provided in the panel edge for accommodating a snap-tab portion of the clip to releasably secure the same to the panel. Such panel further includes at least one slot in each stem of the J-shaped flanges and the strut includes a plurality of vertically spaced slots in the sides thereof in vertical alignment and adjacent such one slot in the J-shaped flanges for facilitating vertical adjustment of the strut and thus the head without disassembly of the same and with the panel assembled in a partition wall.

It is accordingly a principal object of the present invention to provide a head assembly for a partition wall panel which is simple in construction and facilitates quick and easy assembly and disassembly of the partition wall and the mounting thereof against a ceiling.

It is another object of the invention to provide such a head and panel assembly which provides a light and sound shield between the panel head and ceiling and between adjacent head assemblies.

It is still another object of the invention to provide such a head assembly for a post-less panel of the type described.

It is yet another object of the invention to provide such a head assemby for a partition wall panel which may be locked positively at a plurality of discrete positions.

It is still yet another object of the present invention to provide such a head and panel assembly which may be independently vertically adjusted at both sides of the panel without disassembly of the same and with the panel assembled in a partition wall.

It is a further object of the present invention to provide such a head assembly for a partition panel comprised of few parts.

It is another further object of the present invention to provide such a panel and head assembly which is aesthetically pleasing in appearance and which gives a permanent appearance to the partition wall formed therewith.

It is a still further object of the present invention to provide adequate structure to support hanging shelves and casework.

Other objects and advantages of the present invention will become apparent as the following decription proceeds.

To the accomplishment of the foregoing and related ends, the invention then, comprises the features hereinafter fully described and particularly pointed out in the claims, the following description and the annexed drawing setting forth in detail an illustrative embodiment of the invention, this being indicative, however, of but one of the various ways in which the principles of the invention may be employed.

DESCRIPTION OF THE PREFERRED EMBODIMENT

Figures 1, 2, 3, 4, 5, 6, 7, 8:
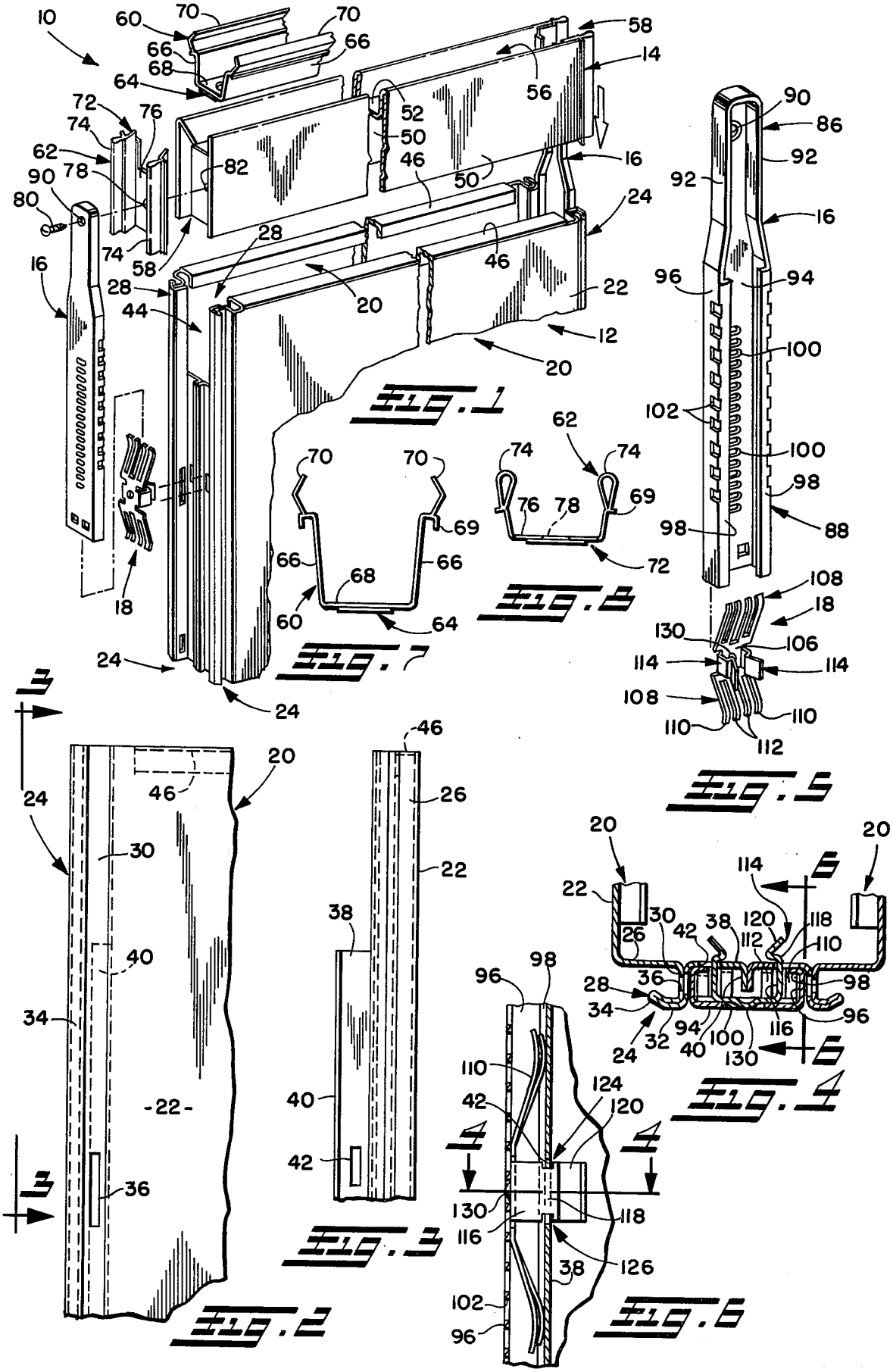
FIG. 1 is a fragmentary, exploded perspective illustration of a preferred form of partition panel and head assembly constructed in accordance with the present invention.
FIG. 2 is a fragmentary front elevation of a panel face plate.
FIG. 3 is a fragmentary side elevation of a panel face plate, as seen from the line 3—3 of FIG. 2.
FIG. 4 is an enlarged fragmentary section taken from the line 4—4 of FIG. 6, illustrating the panel mounting edge, head assembly strut and strut retaining clip cooperating therewith.
FIG. 5 is an exploded perspective illustration of the strut and retaining clip therefor prior to insertion of the clip into the strut.
FIG. 6 is a fragmentary section substantially taken from the line 6—6 of FIG. 4, with portions of the strut and panel flange broken away and sectioned to show the strut retaining clip in profile.
FIG. 7 is an enlarged end view of the ceiling trim seal of FIG. 1.
FIG. 8 is an enlarged top view of the panel trim seal of FIG. 1.

Referring now in greater detail to the drawing, and initially to FIG. 1, a head assembly 10 constructed in accordance with the invention for use in combination with a panel 12 is shown and comprises generally a vertically extensible head 14, vertically positionable strut 16 and strut retaining clip 18, the configurations and assembly of which will be described below. Although the head assembly 10 is primarily intended for use in combination with the type of panel 12 shown and described, it will be appreciated that such head assembly 10 may be utilized with other types of panels.

The Panel 12

As seen in FIGS. 1–4, the panel 12 is is constructed from a pair of substantially parallel, spaced-apart metal face plates 20 of a preferably thin gauge sheet metal having substantially rectangular planar central portions 22 and opposite edge portions 24. The edge portion 24 of each face plate 20 is bent inwardly to define web portion 26 extending the full height of the metal plate 20. The web portion extends substantially normal to central portion 22. The edge portion is further bent outwardly from web portion 26 and is reversely folded to define a recessed, J-shaped flange 28 having main, intermediate and terminal double folded portions 30, 32 and 34 respectively. Main folded portion 30 extends outwardly from web portion 26 substantially perpendicular thereto; intermediate folded portion 32 extends outwardly from main folded portion 30 substantially perpendicular thereto; and terminal folded portion 34 extends inwardly from intermediate folded portion 32 and outwardly away from main folded portion 30. A plurality of longitudinally spaced slots 36 are formed in main folded portion 30 of the recessed flange 28 for attachment of wall hanging accessories, e.g., task surfaces, task lights, shelves and cabinets. The edge portion 24 extends further inwardly from recessed flange 28 to form inner web portion 38 which extends substantially from web portion 26. The inner web portion 28 terminates in an outwardly bent terminal connecting flange 40 which extends substantially normal to inner web portion 38. A vertically extending clip tab receiving slot 42 is provided in the inner web portion 38 for a purpose to be described.

The face plates 20 are reversely positioned with the central portions 22 thereof spaced apart, and with the terminal flanges 40 thereof juxtaposed or butted so as to form panel 12. The abutting terminal flanges may be secured together by suitable means. The bending and folding of the sheet metal face plates, and their manner of securement together, provides mounting panel edges which are very strong and capable of serving as structural supporting members themselves with or without posts. If desired, the space between central portions 22 may be reinforced by a honeycomb or rib structure and/or filled with suitable fire and sound insulation material whereby the panel may meet the various strength and fire resistance codes.

To form a partition wall, panels 10 are positioned in in-line relationship with central portions 22 forming the partition wall surfaces. The mounting panel edges are adjacent one another with the intermediate folded portions 32 juxtaposed. The J-shaped flanges 28 of adjacent panels may be readily joined together by suitable means such as by connector strips disclosed in applicant's assignnee's above mentioned application.

As should be apparent from FIG. 1, the inner web portions 38 and connecting flanges 40 do not extend the entire length of the free plates 20 but are cut back to form a recess 44 between opposed J-shaped flanges 28 adapted to accommodate the head 14. The face plates 20 further may be provided with inwardly and downwardly folded flanges 46 along the upper edges thereof for stiffening and to facilitate assembly with the head 14.

The Head 14

The head 14 comprises a pair of substantially parallel faces 50 which are maintained in spaced-apart relationship by central portion 52. The faces 50 extend substantially the width of the face plates 20 and are spaced apart less than the spacing between folded flanges 46 so that the head may be telescopically received between the inwardly folded flanges 46 for relative upward and downward movement. The head thus is vertically extensible for adapting the panel to ceilings of different heights.

The faces 50 and central portion 52 define respectively the sides and base of a channel which is substantially inverted U-shaped in longitudinal section and has horizontal channel portion 56 along the upper edge of the head 14 and vertical channel portions 58 at each end of the head 14. The U-shape channel may extend over a clip or attachment device, or alternatively, the outer edge of the channel may fit into a recess common to integrated ceilings such as Armstrong C-60.

Positioned respectively within the horizontal and vertical channels 56 and 58 are ceiling and panel trim seals 60 and 62. As best seen in FIG. 7, the ceiling trim seal 60 is preferably a plastic co-extrusion having a central U-shaped body 64, the legs 66 of which normally extend substantially perpendicular to the base 68 of the body but slightly laterally away from each other whereby when inserted in the channel, the legs embrace the sides of the channel 56 and form a seal therewith. At their distal ends, the legs 66 extend outwardly and then backwardly upon themselves to define hook-shaped end flanges 69 which receive therein the upper edges of the faces 50. The ceiling trim seal is also formed with relatively flexible V-flanges 70 at the distal ends of the legs.

The U-shaped body is sufficiently flexible to allow placement of the same in the channel, but relatively stiff to provide for securing the same within the channel 56 by suitable fastening means such as double sided adhesive tape if desired. The flanges will be compressively deformed by engagement with the ceiling to form a seal therewith when the head is brought into abutment with the ceiling. Accordingly, there is provided a sound and light barrier between the ceiling and panel.

As best seen in FIG. 8, the panel trim seal 62 is preferably a plastic co-extrusion and is similar in shape to the ceiling trim seal 60, and includes U-shaped body 72, and flanges 73 and relatively flexible flanges 74. The flanges 74 however are in the form of hollow beads and are of sufficient dimension to engage the flanges of an adjacent panel seal member secured to an adjacent panel head thus to form a light and sound seal between the heads of adjacent panels. In addition, the end flanges 73 do not have a reversely extending portion and thus do not overlap the faces 50. It can also be seen in FIG. 1 that the trim seal is notched at its upper end to accommodate the ceiling trim seal. The base 76 of the body 72 is provided with aperture 78 through which a fastener such as sheet metal screw 80 extends. The threaded end of the screw 80 is threadably received in opening 82 in the base of the vertical channel 58 to secure the panel trim and seal member 62 in such vertical channel 58. It will be appreciated that this same fastener may be used to secure together the strut 16 and head 14.

The Strut 16

Referring now additionally to FIGS. 5 and 6, the strut 16 comprises an upper tongue portion 86 and a lower channel portion 88. The tongue portion 86 is of a reduced width and is received between the legs of the panel trim seal 62 within the vertical channel 58. A hole 90 is provided in the tongue portion 86 through which the fastener 80 may pass thus to secure together the strut 16 and head 14. Preferably, the hole 90 is countersunk so that the head of the fastener is recessed and thus will not interfere with the strut of an adjacent panel and head assembly which will be reversely positioned in close proximity to the strut 16 when the panels are assembled together in a preferred manner. The tongue portion may have inwardly bent legs 92 which serve to rigidify the same.

The lower channel portion 88 of the strut is C-shape in transverse section and includes central web portion 94 and leg portion 96 which terminate in inwardly extending terminal flanges 98. The channel portion 88 is dimensioned to be received for sliding vertical movement in a track defined between the main folded portions 30 of the J-shaped flanges 28 with the leg portions 96 juxtaposed thereagainst and the terminal flanges 98 against the inner web portions 38 of the face plates for preventing lateral displacement of the strut relative to the panel. The strut 16 should not extend outwardly beyond the intermediate portions 32 of the flanges as it would preclude securing together adjacent panels in the preferred manner describd above. For purposes that will become apparent below, the web portion 94 of the channel portion 88 is provided with a plurality of laterally spaced openings 100 and the legs 96 are provided with a plurality of longitudinally spaced slots 102 which are vertically aligned with at least one of the slots 36 in the flanges 28 when the strut is received in the vertical track.

As best seen in FIG. 5, the channel portion 88 of the strut is open at is lower end and may receive therein the clip 18 for sliding frictional engagement therewith to secure the strut to the panel as will become more apparent below.

The Clip 18

The clip 18 has a body 106 and a pair of resilient wings 108 which extend longitudinally in opposite directions and laterally in the same direction. The wings 108 each include pairs of longitudinally extending outer and inner prongs 110 and 112, respectively. The outer prongs 110 at their ends extend laterally away from the body a distance greater than that between the strut web portion 94 and terminal flanges 98 and are spaced apart such that they will bear against the terminal flanges 98 when the clip 18 is received in the channel portion 88 of the strut. The inner prongs 112 are disposed inwardly of the outer prongs 110 and when received in the strut 16, are positioned inwardly of the strut terminal flanges 98. The inner prongs 112 at their ends extend laterally away from the body a distance such that when the body 106 abuts the strut web portion 94, the inner prongs 112 project beyond the terminal flanges 98 for a purpose which will become apparent below. The distal ends of the prongs may be reversely bent if desired.

The body 106 preferably is substantially rectangular in shape with the wings 108 extending from one set of opposed sides and a pair of snap tabs 114 extending from the other set of opposed sides. The tabs 114 each have a vertical planar extent and include inner portions 116, intermediate portions 118 and outer portions 120. The inner portions 116 extend substantially perpendicular to the body 106 and are spaced apart a distance substantially equal that between the slots 42 provided in the inner webs 38 of the panel edges 24. The intermediate portions 118 extend inwardly to such an extent that the spacing therebetween is less than that between the slots 42. The outer portions 120 extend diagonally outwardly away from the base and from each other. The spacing between the distal ends of the outer portions 120 preferably is greater than the spacing between the adjacent vertical sides of the slots 42 but less than the spacing between the opposed vertical sides of the respective slots 42. The intermediate portion 118 preferably is recessed at its upper and lower edges to form in conjunction with the outer portions 120 upper and lower hooks 124 and 126, respectively.

The Assembly

With the clip construction as thus described, the clip 18 may be secured to the panel edges by inserting the snap tabs 114 in the corresponding slots 42 in the inner web portion 38 of the panel. As the tabs 114 are first inserted, the outer portions 120 will cam the tabs away from each other until the intermediate portions 118 are aligned with the inner web portions 38 at which time the tabs will snap inwardly and lock the clip in place. In addition the hooks 124 and 126 will cooperate with the slots 42 to secure further the clip to the panel. Any play of the clip relative to the panel will be taken up by the inner prongs 112 which will bear against the inner web portions 38 and urge the clip outwardly away from the panel until the intermediate portions 118 of the tabs abut the inner sides of the web portions.

With the clip 18 in place, the strut 16 may be pushed downwardly so that the clip 18 is received in the channel portion 88 thereof, and preferably to its lowest position. The outer prongs 110 will bear against the inner surfaces of the terminal flanges 98 and resiliently urge the body 106 of the clip into frictional engagement with the web portion 94 of the strut 16, and thus continuously supports the strut 16 through all vertical positions thereof. In addition to providing continuous support for the strut, the resilient outer prongs urge positively a dimple 130 provided in the body 106 into any one of the aligned openings 100 in the web portion to lock positively the strut at any one of a plurality of discrete locations. It will be appreciated that substantial force is required to move the strut between locking positions.

Preferably, a strut is secured to both vertical edges of the panel and the head secured at each end to the struts 16 by fasteners 90. Of course, the seal and trim members may also be secured in place.

Although one method of assembling the panel and head assembly is described, it will be appreciated that the same may be assembled in different ways. For example, the struts may be first secured to the panel head and then pushed downwardly so that the clips are inserted in the strut.

With the head 14 in its lowest position, the panel 12 may now be positioned in the partition wall and secured to adjacent panels by suitable connectors in the preferred manner. With the panels assembled in the partition wall, the head 14 may be adjusted vertically upwardly into engagement along its upper edge with the ceiling. Such vertical adjustment is facilitated by inserting a screwdriver or the like through one of the vertical slots 36 provided in the J-shaped flanges 28 for prying upwardly the strut 16 be engagement with one of the relatively shorter slots 102 in the strut from one locking position to the next. In ratchet-like fashion, the strut 16 may be progressively moved upwardly from locking position to locking position until the ceiling trim and seal member engages the ceiling. Alternatively, the screwdriver or the like may be inserted through the larger slot 36 into engagement with an adjacent smaller slot 102 and tapped at its handle such as with a hammer to drive the strut upwardly or downwardly.

It thus can be seen that the vertical extension of the head 14 may be readily adjusted within disassembly of the various components or the panel from the partition wall. It should also be appreciated that the head may engage the ceiling with sufficient force such that the panel will be self-supported between the ceiling and floor. If desired, the head may be secured to the ceiling by suitable fasteners.

Although the present invention is described particularly for a head assembly for a partition panel, it should be appreciated that the principles of the invention may be equally applicable to a foot assembly for a partition panel.

The embodiments of the invention in which an exclusive property or privilege is claimed are defined as follows:

1. The combination of a partition panel, a telescoping head in the top thereof and strut means at at least one end of the head adjustably vertically secured to the partition at all vertical positions thereof, said strut means comprising a strut having an upper portion connected to said head and a lower channel-shape portion, clip means slidingly received in said lower channel-shape portion, said clip means including means for securing the same to said partition panel, said clip means further comprising resilient means for frictionally engaging said clip means with said lower channel-shape portion of said strut, said clip means comprising a body and said resilient means including a pair of resilient wings extending longitudinally from said body in opposite directions and laterally in the same direction, said lower channel-shape portion of said strut being substantially C-shape in transverse section having a web portion, leg portions extending from each vertical edge of said web portion, and inwardly extending terminal portions at the ends of said leg portions substantially parallel with said web portion and spaced apart therefrom, and said wings extending laterally from said body a distance greater than the spacing between said web portion and terminal portions whereby when received in said channel-shape portion of said strut, said wings resiliently urge said body into frictional engagement with said web portion of said lower channel-shape portion.

2. The combination of claim 1 further comprising lock means for releasably locking said strut and clip means at a plurality of discrete positions.

3. The combination of claim 2 wherein said lock means comrises at least one dimple in one of said web portion and body and at least one cooperating recess in the other of said web portion and body.

4. The combination of a partition panel, a telescoping head in the top thereof and strut means at at least one end of the head adjustably vertically secured to the partition at all vertical positions thereof, said strut means comprising a strut having an upper portion connected to said head and a lower channel-shape portion, clip means slidingly received in said lower channel-shape portion, said clip means including means for securing the same to said partition panel, said clip means further comprising resilient means for frictionally engaging said clip means with said lower channel-shape portion of said strut, said clip means comprising a body and said resilient means including a pair of resilient wings extending longitudinally from said body in opposite directions and laterally in the same direction, said clip means also comprising a pair of tabs extending from said body, said partition panel including a pair of slots for receipt of said tabs, said tabs extending substantially perpendicular to said body and each then inwardly and finally outwardly, and the inwardly extending portion being of reduced width relative to the outwardly extending portion to form a hook thereon.

5. The combination of claim 4 wherein the distal ends of said outwardly extending portions of said tabs are spaced apart a distance greater than said slots whereby when said tabs are inserted in said slots in said panel, said outwardly extending portions are initially cammed away from one another.

6. The combination of claim 4 wherein the spacing between said inwardly extending portions of said tabs is less than the spacing between said slots.

7. The combination of claim 4 wherein said lower channel-shape portion of said strut is substantially C-shape in transverse section having a web portion, leg portions extending from each vertical edge of said web portion, and inwardly extending terminal portions at the ends of said leg portions substantially parallel with said web portion and spaced apart therefrom, and wherein said wings each comprise pairs of inner and outer prongs, said outer prongs being adapted to engage said terminal portions of said strut and said inner prongs being adapted to engage said panel to urge resiliently said clip away from said panel until such inwardly extending portions of said tabs engage said panel.

8. In a full height partition system, a panel, a vertically adjustable head for said panel, a strut connected to said head at at least one end thereof, and spring detent means for continuously securing said strut to said panel while allowing for vertical adjustment of said strut through a plurality of vertically adjusted positions.

9. A system as set forth in claim 8 wherein said spring detent means comprises a series of vertically spaced openings in one of said panel or strut, and a detent on the other cooperating with said spaced openings for releasably locking said strut at such plurality of vertically adjusted positions.

10. A system as set forth in claim 9 wherein said detent is resiliently urged into engagement with said openings.

11. A system as set forth in claim 8 wherein said spring detent means is secured to said panel and is spring loaded into engagement with said strut.

12. A system as set forth in claim 8 wherein said spring detent means includes spring friction means engaging said strut.

13. A system as set forth in claim 12 wherein said spring friction means includes a spring clip secured to said panel.

14. A system as set forth in claim 13 wherein said spring clip resiliently holds said strut to said panel.

15. A system as set forth in claim 14 wherein said strut has a sectional configuration of a C, and said spring clip extends into the C.

16. A system as set forth in claim 8 wherein said head comprises a channel of U-shape longitudinal cross-section, and seal means in said channel for sealing engagement with the ceiling and adjacent panels when the partition panel is in place.

17. A system as set forth in claim 16 wherein said seal means is a plastic coextrusion having a substantially rigid U-shape portion received in said channel and a relatively flexible flange projecting outwardly at the distal ends of the legs of said U-shape portion.

18. A system as set forth in claim 17 wherein said seal means comprises end flanges extending outwardly from said distal ends of said legs for engaging the upper edges of said channel of U-shape longitudinal cross-section.

19. A system as set forth in claim 17 wherein said channel of U-shape longitudinal cross-section includes a horizontal and vertical portion, and said seal means includes horizontal and vertical plastic coextrusions in said horizontal and vertical portions, respectively.

20. A system as set forth in claim 17 wherein the relatively flexible flange of said vertical plastic coextrusion includes hollow beads extending longitudinally along said distal ends of said legs.

21. In a full height partition system, a panel, a vertically adjustable head for said panel, a strut connected to said head at at least one end thereof, spring detent means securing said strut to said panel in a plurality of vertically adjusted positions, said spring detent means including a series of vertically spaced openings in one of said panel or strut and a detent on the other cooperating with said spaced openings for releasably locking said strut at such plurality of vertically adjusted positions, and aligned vertical rows of slots in said panel and strut to facilitate the vertical movement of said strut with respect to said panel by the external application of a prying tool.

22. In a full height partition system, a panel, a vertically adjustable head for said panel, a strut connected to said head at at least one end thereof, and spring detent means securing said strut to said panel in a plurality of vertically adjusted positions, said spring detent means including spring friction means engaging said strut, said spring friction means including a spring clip secured to said panel, said spring clip resiliently holding said strut to said panel, said strut having a sectional configuration of a C, said spring clip extending into the C, said strut having a web portion, leg portions extending from each vertical edge of said web portion, and inwardly extending terminal portions at the ends of said leg portions substantially parallel with said web portion and spaced apart therefrom, and said spring clip including spring feet bearing against the inside of said terminal portions of said strut to hold said strut to said panel.

23. In a full height partition system, a panel, a vertically adjustable head for said panel, a strut connected to said head at at least one end thereof, and spring detent means securing said strut to said panel in a plurality of vertically adjusted positions, said panel including a pair of face plates bent inwardly at its vertical edges and then upon itself to form a pair of double thickness vertically extending recessed flanges, and said flanges defining a track therebetween, and said strut being slidably received in said track for vertical movement therealong.

24. A partition panel construction comprising a panel having vertical mounting flanges along its vertical edges adapted to be demountably held to juxtaposed mounting flanges of an adjacent panel, said mounting flanges being spaced apart and defining therebetween a narrow track, a panel extension member movable vertically in said track, and spring detent means securing said extension member to said panel in a plurality of vertically adjusted positions.

25. The construction of claim 24 wherein said panel extension member is confined within the envelope defined by said mounting flanges so that two extension members can be accomodated in the respective opposed narrow tracks between said mounting flanges when adjacent panels are interconnected.

26. The construction of claim 24 wherein said mounting flanges include means for providing access to said panel extension member for effecting vertical adjustment of said extension member when adjacent panels are interconnected.

27. The construction of claim 26 wherein said panel has spaced parallel vertical faces and vertical edges normal to said faces, and said mounting flanges are inwardly recessed from said faces and define with said panel edges a narrow vertical window, and said means for providing access includes an opening in said mounting flange accessible through said window so that a prying tool can easily be inserted through said window into said opening and into engagement with said extension member.

28. In a partition system, a vertical support member, a vertical extension member therefor and spring detent means for securing said extension member to said support member in a plurality of vertically adjusted positions; said extension member having a web portion, leg portions extending from each vertical edge of said web portion, and inwardly extending terminal portions at the ends of said leg portions substantially parallel with said web portion and spaced apart therefrom, whereby said extension member has a sectional configuration of a C; and said spring detent means including a spring clip secured to said support member and extending into the C, said spring clip including spring feet bearing against the inside of said terminal portions of said extension member to hold said extension member to said support member.

29. A system as set forth in claim 28 further comprising means for releasably locking said extension member at a plurality of discrete positions thereof.

* * * * *